US010477628B2

(12) United States Patent
Mortimer

(10) Patent No.: US 10,477,628 B2
(45) Date of Patent: Nov. 12, 2019

(54) TRANSVERSE FLUX ELECTRIC INDUCTION HEAT TREATMENT OF A DISCRETE WORKPIECE IN A GAP OF A MAGNETIC CIRCUIT

(71) Applicant: Radyne Corporation, Milwaukee, WI (US)

(72) Inventor: John Justin Mortimer, Genesee, WI (US)

(73) Assignee: Radyne Corporation, Milwaukee, WI (US)

( * ) Notice: Subject to any disclaimer, the term of this patent is extended or adjusted under 35 U.S.C. 154(b) by 478 days.

(21) Appl. No.: 15/375,742

(22) Filed: Dec. 12, 2016

(65) Prior Publication Data

US 2017/0094728 A1 Mar. 30, 2017

Related U.S. Application Data

(62) Division of application No. 13/242,605, filed on Sep. 23, 2011, now Pat. No. 9,521,709.

(60) Provisional application No. 61/385,778, filed on Sep. 23, 2010.

(51) Int. Cl.

| | |
|---|---|
| ***H05B 6/04*** | (2006.01) |
| ***H05B 6/36*** | (2006.01) |
| ***H05B 6/10*** | (2006.01) |

(52) U.S. Cl.

CPC ..... *H05B 6/103* (2013.01); *H05B 6/104* (2013.01); *H05B 6/36* (2013.01); *H05B 6/362* (2013.01); *H05B 6/365* (2013.01)

(58) Field of Classification Search

CPC ..... H05B 6/103; H05B 6/104; H05B 6/36; H05B 6/362; H05B 6/365

USPC ..... 219/606, 608–611, 618, 632, 640, 647, 219/650, 653, 656, 660, 672, 674, 676, 219/677

See application file for complete search history.

(56) References Cited

U.S. PATENT DOCUMENTS

| | | | | |
|---|---|---|---|---|
| 4,673,781 A * | 6/1987 | Nuns | H05B 6/42 | 219/632 |
| 6,730,893 B1 * | 5/2004 | Runde | H05B 6/365 | 219/635 |
| 2002/0063037 A1 * | 5/2002 | Bruun | B65G 37/02 | 198/370.01 |

* cited by examiner

*Primary Examiner* — Dana Ross
*Assistant Examiner* — James F Sims, III
(74) *Attorney, Agent, or Firm* — Philip O. Post

(57) ABSTRACT

Discrete workpieces move through a longitudinally-oriented through-gap in an open-box rectangular ferromagnetic material. A transverse magnetic flux established in the through-gap inductively heats the discrete workpieces moving through the longitudinally-oriented through-gap. A longitudinal axis of the workpiece or the planar surface of a planarly-oriented workpiece is oriented either parallel to, or perpendicular to, the transverse magnetic flux to heat treat the workpiece.

20 Claims, 14 Drawing Sheets

TRANSVERSE FLUX ELECTRIC INDUCTION HEAT TREATMENT OF A DISCRETE WORKPIECE IN A GAP OF A MAGNETIC CIRCUIT

CROSS-REFERENCE TO RELATED APPLICATIONS

This is a divisional application of application Ser. No. 13/242,605, filed Sep. 23, 2011, which application claims the benefit of U.S. Provisional Application No. 61/385,778, filed Sep. 23, 2010, both of which applications are hereby incorporated herein by reference in their entireties.

FIELD OF THE INVENTION

The present invention relates to electric induction heat treatment of electrically conductive articles or workpieces wherein a transverse flux is established in a gap in a magnetic circuit with the transverse flux either parallel to, or orthogonal to, a longitudinal axis of the article or workpiece to be heat treated, or perpendicular to a planar surface of a planar workpiece.

BACKGROUND OF THE INVENTION

FIG. 1 illustrates one type of electrically conductive workpiece, or preform 90, that is a closed bottom cylindrically shaped hollow metal preform with longitudinal axis $L_{90}$. The closed bottom, as shown in cross section in FIG. 1, has a much greater thickness than the side wall of the preform. For example, for a preform with an overall cylindrical height of 4 inches and diameter of 0.2 inch, the side wall (90*a*) thickness may be on the order of 0.002-inch while the bottom and bottom side wall (90*b*) may be on the order of 0.1-inch.

A known method of heat treating such preforms is by passing a continuous row of preforms 90 through an electric induction tunnel furnace wherein a channel coil establishes a vertically oriented magnetic flux coupling with the preform structure to inductively heat the preform structure. Such heat treatment requires higher magnetic field intensities to heat the preform since the circumference of the preform is very highly conductive to a vertical field.

It is one object of the present invention to provide an apparatus and method for transverse flux electric induction heat treatment of electrically conductive articles or workpieces that have at least one section with a longitudinal axis, such as closed bottom cylindrically shaped hollow preforms, by establishing a flux field through the article that is either generally parallel to, or orthogonal to, the longitudinal axis of the section of the article depending upon the characteristics of the workpiece, to achieve a higher efficiency heating than presently known.

It is another object of the present invention to provide an apparatus and method for transverse flux electric induction heat treatment of electrically conductive articles or workpieces that are planarly-oriented, such as a blank for stamping into a coin, by establishing a flux field through the article that is generally orthogonal to the planar surface of the article.

It is another object of the present invention to provide an apparatus and method for transverse flux electric induction heat treatment of electrically conductive articles or workpieces that have two or more components with a longitudinal axis, such as a manifold, by establishing a flux field through the article that is either generally parallel to, or orthogonal to, the longitudinal axis of the two or more components of the article depending upon the characteristics of the workpiece, to achieve a higher efficiency heating than presently known.

SUMMARY OF THE INVENTION

In one aspect the present invention is apparatus for, and method of, electric induction heat treatment of an article having at least a section having a longitudinal axis with a magnetic flux field that is generally parallel to, or orthogonal to, the longitudinal axis of the workpiece so that the magnetic flux field passes transversely through the section.

In another aspect the present invention is an electric induction heat treatment apparatus for heat treatment of a discrete workpiece having a longitudinal axis. A series magnetic loop circuit is formed from an open-box rectangular ferromagnetic material. At least one longitudinally-oriented workpiece through-gap is formed in the open-box rectangular ferromagnetic material through which the discrete workpiece passes through. Inductors are positioned around the open-box rectangular ferromagnetic material adjacent to a side of each longitudinally-oriented workpiece through-gap. An alternating current power supply is connected to the inductors to establish a transverse magnetic flux in each one of the longitudinally-oriented workpiece through-gaps, and a discrete workpiece transport system is provided for positioning the longitudinal axis of the discrete workpiece perpendicular or parallel to the transverse magnetic flux as the discrete workpiece passes through the longitudinally-oriented workpiece through-gap.

In another aspect the present invention is a method of inductively heat treating a discrete workpiece having a longitudinal axis. Alternating current power is supplied to a series magnetic loop circuit formed from an open-box rectangular ferromagnetic material having at least one longitudinally-oriented workpiece through-gap. A transverse magnetic flux is established across the width of each longitudinally-oriented workpiece through-gap, and the discrete workpiece is moved with its longitudinal axis perpendicular or parallel to the transverse magnetic flux through one of the longitudinally-oriented workpiece through-gaps.

In another aspect the present invention is an electric induction heat treatment apparatus for heat treatment of at least one discrete planarly-oriented workpiece having a planar surface. A series magnetic loop circuit is formed from an open-box rectangular ferromagnetic. At least one longitudinally-oriented workpiece through-gap is formed in the open-box rectangular ferromagnetic material through which the discrete planarly-oriented workpiece passes through. Inductors are positioned around the open-box rectangular ferromagnetic material adjacent to a side of each one of the longitudinally-oriented workpiece through-gaps. An alternating current power supply is connected to the inductors to establish a transverse magnetic flux in each of the longitudinally-oriented workpiece through-gaps, and a discrete workpiece transport system is provided for positioning the planar surface of the planarly-oriented workpiece perpendicular to the transverse magnetic flux as the discrete planarly-oriented workpieces passes through the longitudinally-oriented workpiece through-gap.

In another aspect the present invention is a method of inductively heat treating at least one discrete planarly-oriented workpiece having a planar surface. Alternating current power is supplied to a series magnetic loop circuit formed from an open-box rectangular ferromagnetic material having at least one longitudinally-oriented workpiece through-gap. A transverse magnetic flux is established across the width of each longitudinally-oriented workpiece through-gap, and the discrete planarly-oriented workpiece is moved with its planar surface perpendicular to the transverse magnetic flux through the longitudinally-oriented workpiece through-gap.

In another aspect the present invention is an electric induction heat treatment apparatus for heat treatment of at least one discrete workpiece having at least two components with a longitudinal axis. A series magnetic loop circuit is formed from an open-box rectangular ferromagnetic material. At least one longitudinally-oriented workpiece through-gap is formed in the open-box rectangular ferromagnetic material through which the discrete workpiece passes. Inductors are positioned around the open-box rectangular ferromagnetic material adjacent to a side of each one of the longitudinally-oriented workpiece through-gaps. An alternating current power supply is connected to the inductors to establish a transverse magnetic flux in each of the longitudinally-oriented workpiece through-gaps, and a discrete workpiece transport system is provided for positioning the longitudinal axis of the at least two components of the discrete workpiece perpendicular to the transverse magnetic flux as each of the discrete workpieces passes through the longitudinally-oriented workpiece through-gap to braze weld the at least two components together.

In another aspect the present invention is a method of inductively heat treating a discrete workpiece having at least two components with a longitudinal axis. Alternating current power is supplied to a series magnetic loop circuit formed from an open-box rectangular ferromagnetic material having at least one longitudinally-oriented workpiece through-gap. A transverse magnetic flux is established across the width of each of the longitudinally-oriented workpiece through-gaps, and each of the discrete workpieces is moved with the longitudinal axis of the at least two components perpendicular to the transverse magnetic flux through one of the longitudinally-oriented workpiece through-gaps.

In another aspect the present invention is induction heat treatment of a closed bottom cylindrically shaped metal preform positioned in the air gap of a magnetic circuit that serves as a flux guide with the longitudinal axis of the preform generally perpendicular to the magnetic flux passing through the air gap. The preform may be contained at least partially within a transport apparatus that is seated at least partially within the air gap.

In another aspect the present invention is induction heat treatment of a workpiece having multiple open cylindrical sections axially aligned with the longitudinal axis of the workpiece. The workpiece is positioned in the air gap of a magnetic circuit that serves as a flux guide with the longitudinal axis of the workpiece generally parallel to the magnetic flux passing through the air gap.

The above and other aspects of the invention are further set forth in this specification and the appended claims.

BRIEF DESCRIPTION OF THE DRAWINGS

For the purpose of illustrating the invention, there is shown in the drawings a form which is presently preferred. It being understood, however, that this invention is not limited to the precise arrangements and instrumentalities shown in the drawings.

FIG. 3(*b*) is a cross sectional view of the apparatus in FIG. 3(*a*) through line A-A.

FIG. 3(*c*) is a cross sectional view of the apparatus in FIG. 3(*a*) through line B-B.

FIG. 3(*d*) is a diagrammatic isometric view of the apparatus in FIG. 3(*a*) illustrating one example of connecting the solenoidal coils to an alternating source power supply.

FIG. 5(*b*) is an enlarged detail view of the side cross sectional elevational view shown in FIG. 5(*a*).

FIG. 6(*b*) is a diagrammatic isometric view of the apparatus in FIG. 6(*a*) illustrating one example of connecting the single turn sheet inductors to an alternating current power supply.

FIG. 7(*b*) is a detail cross sectional view of one of the multi-layer wound ribbon inductors used in the apparatus shown in FIG. 7(*a*).

FIG. 7(*c*) is a plan view of one example of a ribbon inductor used in the apparatus shown in FIG. 7(*a*) before winding around the ferromagnetic material adjacent to a through-gap.

FIG. 7(*d*) is a cross sectional view of the ribbon inductor shown in FIG. 7(*c*) and used in the apparatus shown in FIG. 7(*a*) after winding around the ferromagnetic material adjacent to a through-gap.

FIG. 8(*b*) through FIG. 8(*e*) are various field shaping channel tips that can be used in various examples of an electric induction heat treatment apparatus of the present invention.

FIG. 9(*b*) is a cross sectional view of the apparatus shown in FIG. 9(*a*) through line C-C that illustrates the single-turn sheet inductor enclosing a ferromagnetic material.

FIG. 10(*b*) is a partial detail view of the apparatus shown in FIG. 8(*a*) with the workpiece shown in FIG. 10(*a*) in place for induction heat treatment of the workpiece with a magnetic flux field that is established parallel to the longitudinal axis of the workpiece.

FIG. 10(*c*) is a partial detail view of the apparatus shown in FIG. 8(*a*) with the workpiece shown in FIG. 10(*a*) in place for induction heat treatment of the workpiece with a magnetic flux field that is established perpendicular to the longitudinal axis of the workpiece.

FIG. 11(*b*) is a partial detail view of the apparatus shown in FIG. 8(*a*) with the workpiece shown in FIG. 11(*a*) in place for induction heat treatment of the workpiece with a magnetic flux field that is established parallel to the planar surface of the planarly oriented workpiece.

FIG. 12(*b*) is a partial detail view of the apparatus shown in FIG. 8(*a*) with the workpiece shown in FIG. 12(*a*) in place for induction heat treatment of the workpiece with a magnetic flux field that is established perpendicular to the longitudinal axis of the components of the workpiece.

DETAILED DESCRIPTION OF THE INVENTION

While the present invention will be described in connection with a preferred embodiment, it will be understood that it is not intended to limit the invention to that embodiment. On the contrary, it is intended to cover all alternatives, modifications and equivalents as may be included within the scope of the invention.

Figure 1:
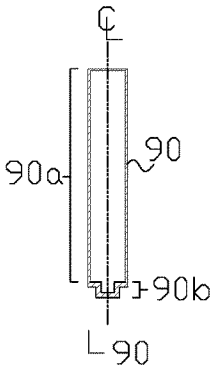
FIG. 1 is a cross sectional elevational view of one example of a workpiece with a section having a centerline longitudinal axis that can be induction heat treated with the apparatus and method of the present invention.
Figure 2:
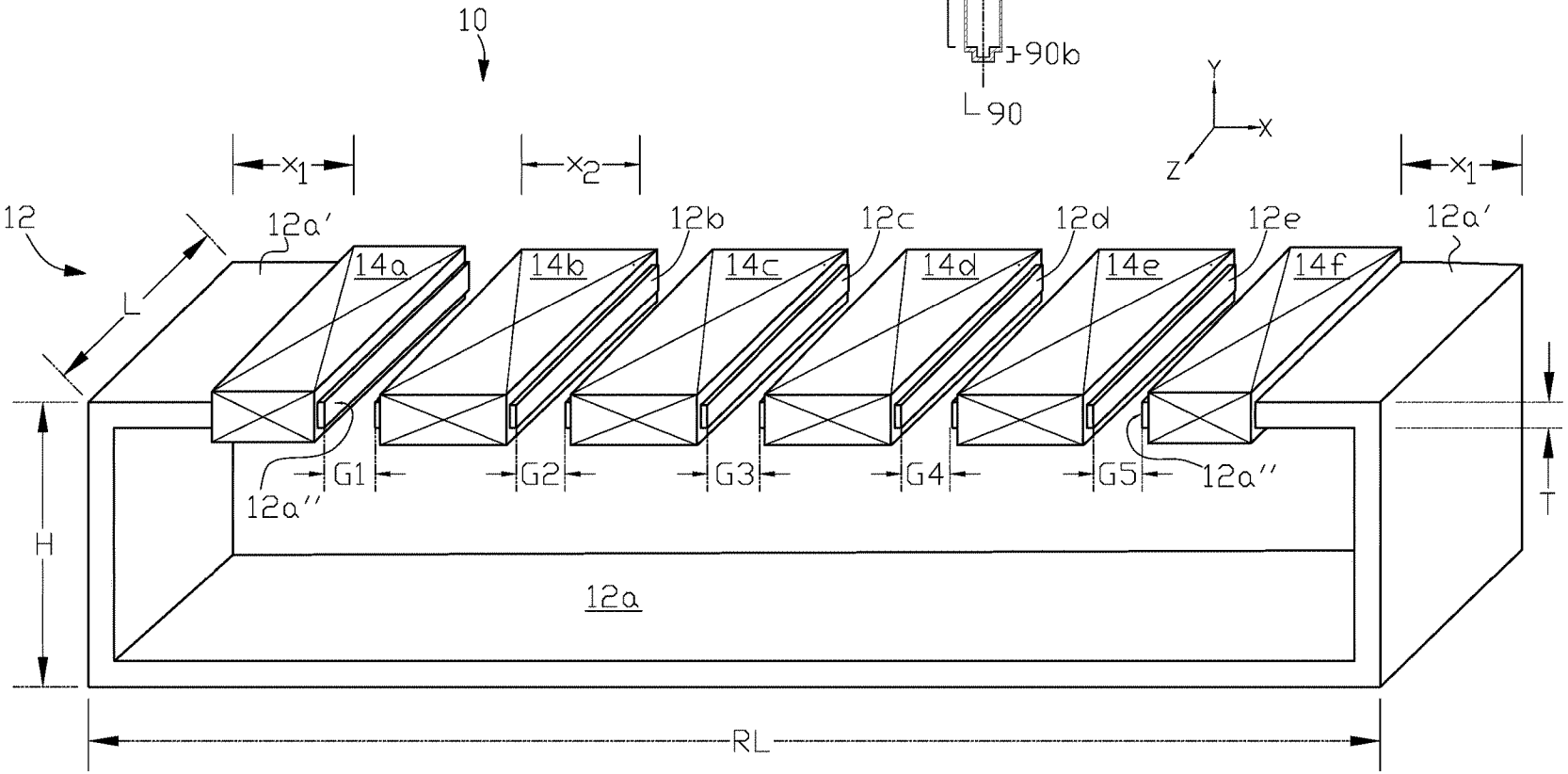
FIG. 2 is an isometric view of one example of an electric induction heat treatment apparatus of the present invention.
Figure 3A:
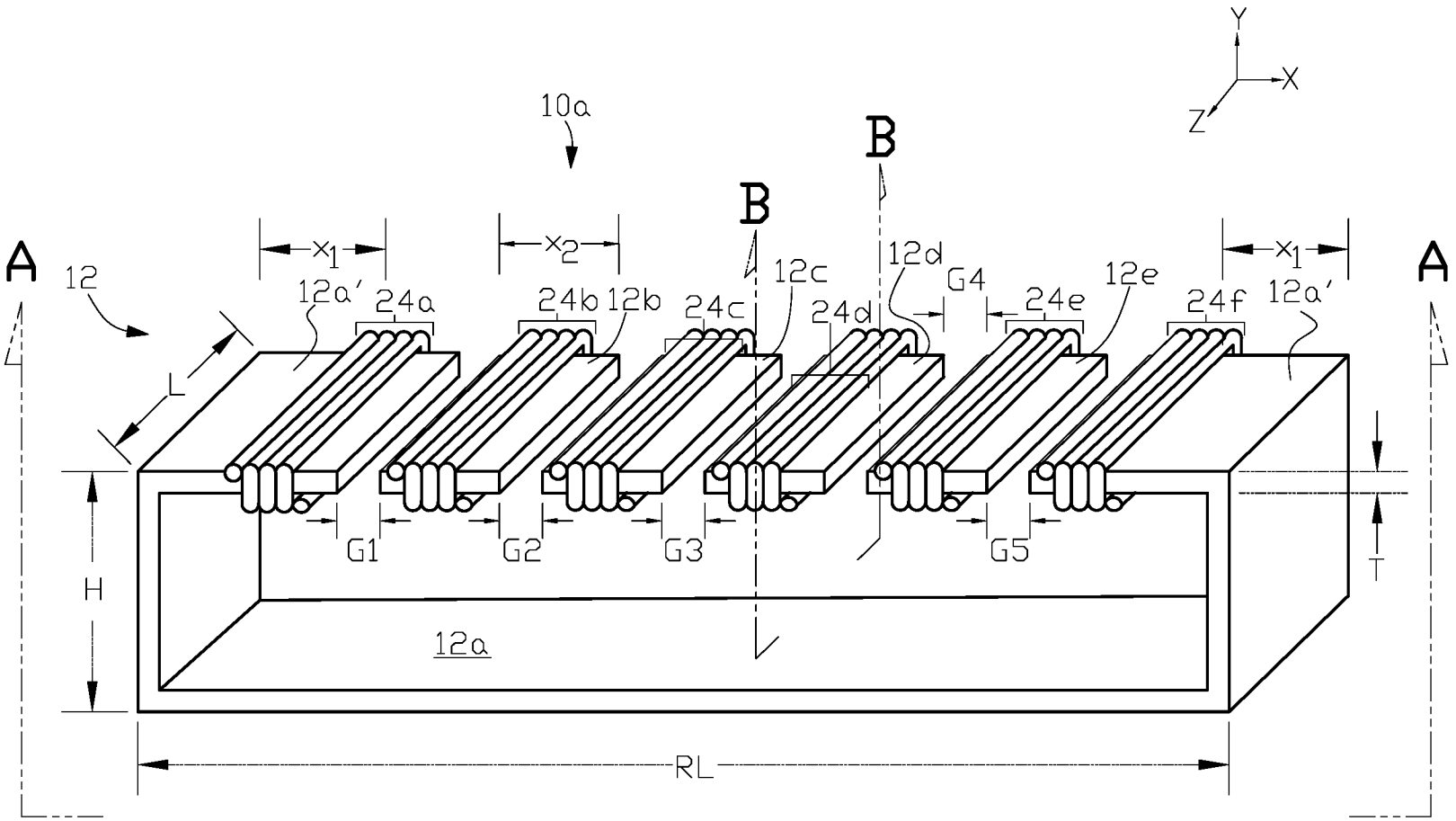
FIG. 3(*a*) is an isometric view of another example of an electric induction heat treatment apparatus of the present invention utilizing solenoidal coils.
Figure 3C:
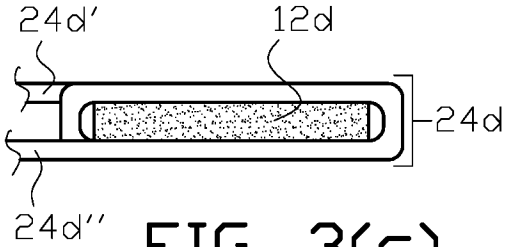
Figure 3B:
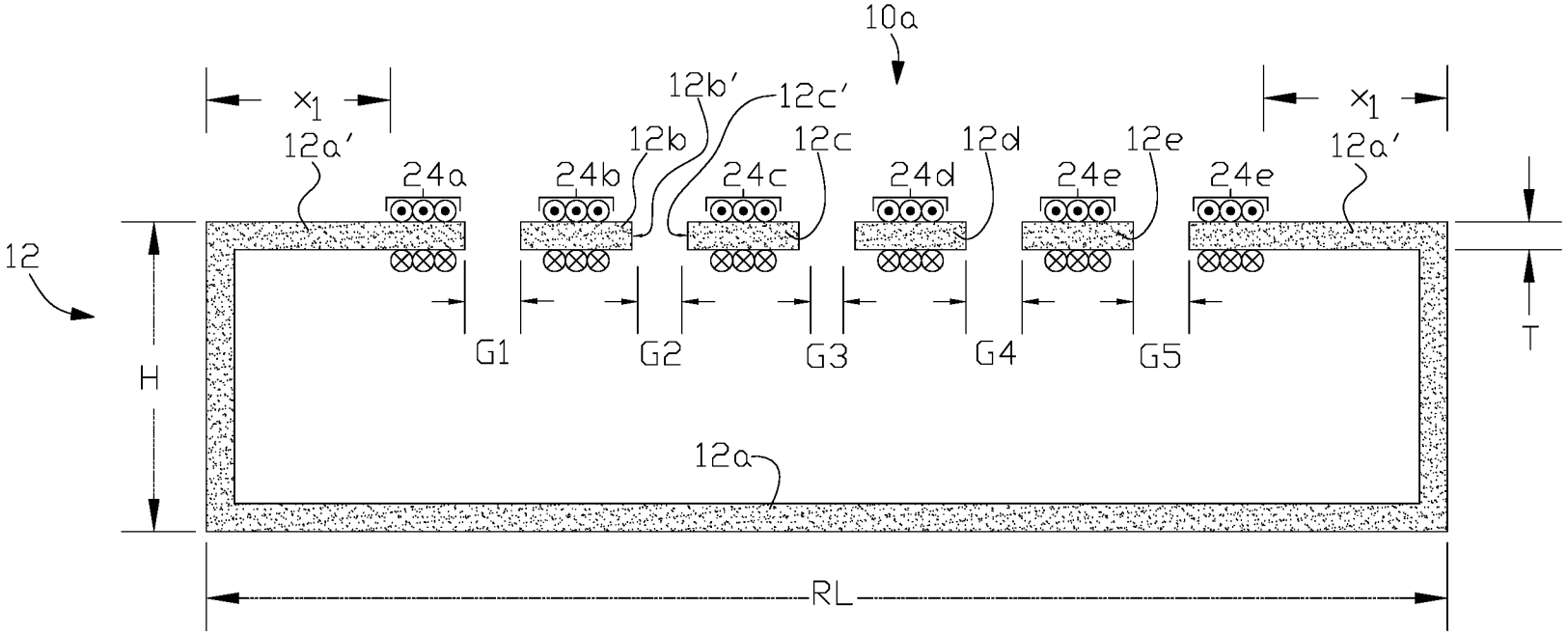
Figure 3D:
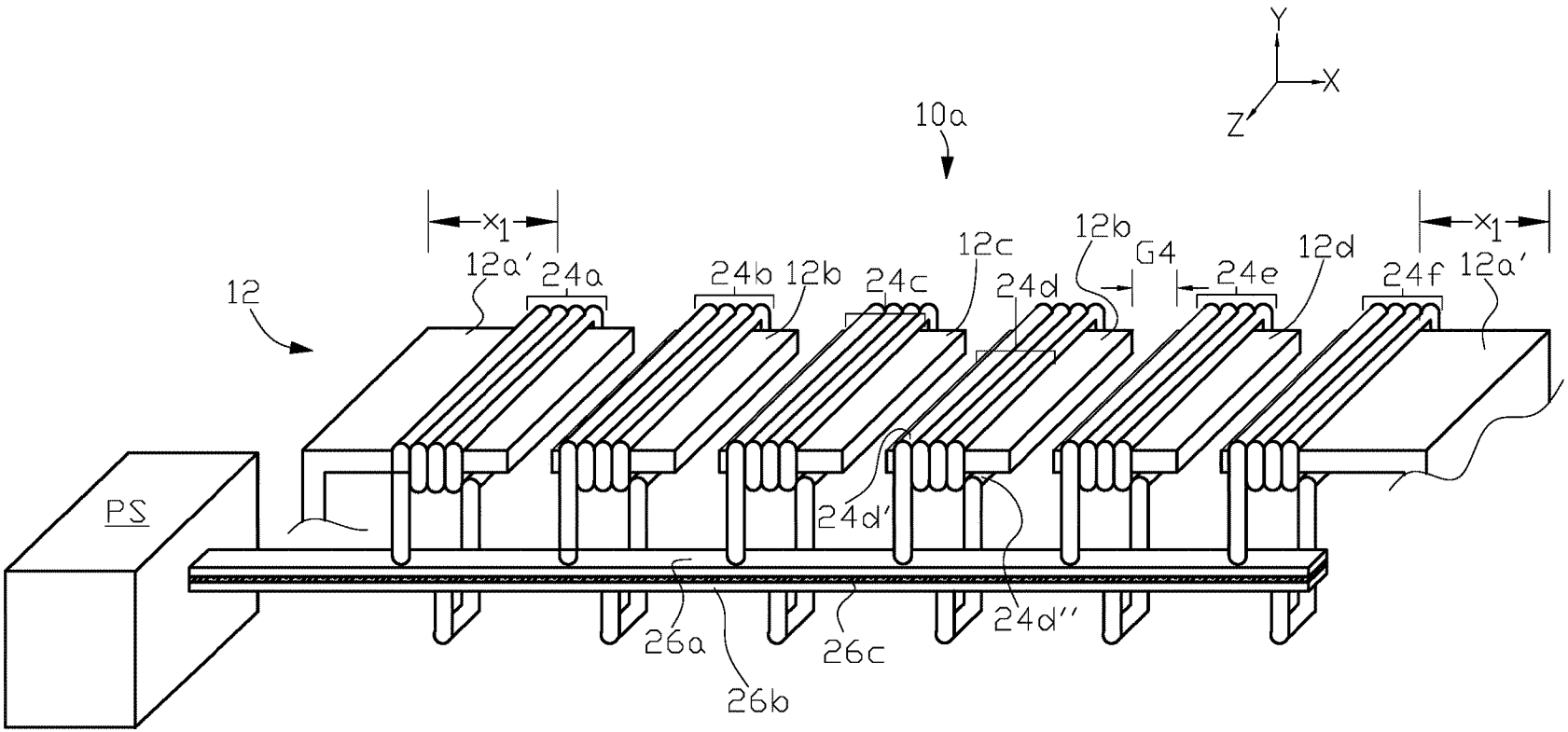

FIG. 2 illustrates one example of an electric induction heat treatment apparatus 10 of the present invention. A magnetic circuit, or flux guide, is formed from a suitable ferromagnetic material 12 arranged in a generally open box, rectangular configuration with one or more longitudinally oriented air gaps G1 through G5. The ferromagnetic material can be, for example, of laminated or pressed powder ferrite form with suitable support structure. One or more discrete workpieces can be moved through one of the longitudinally-oriented gaps so that a transverse magnetic field (oriented in the X-direction of the X-Y-Z orthogonal space illustrated in the figure) established perpendicularly to, or parallel to a longitudinal axis of the discrete workpiece, or perpendicular to a planar surface of the discrete workpiece in the through-gap inductively couples and heats the discrete workpiece moving through the gap. The thickness, T, of the apparatus is determined by the configuration and size of the workpiece, and the length, L, of the gaps is determined by parameters such as the speed of the workpieces moving through the gaps and the level of inductive heating required for the time that a workpiece is within the through-gap. The height, H, and return length, RL, of the apparatus are minimized as applicable for a particular application. If required for a particular application, ends of C-shaped section 12*a*' are of sufficient length, $x_1$, to ensure that the magnetic flux in each end section 12*a*' is oriented in parallel with the X-axis at the tip 12*a*" of each end section so that the flux across gap G1 and gap G5 is substantially parallel across each gap and perpendicular to the length of a workpiece moving through each of these gaps. Minimum spacing $x_2$, between adjacent gaps is determined by the length, $x_2$, of the inductors (also referred to as induction coils) required to provide sufficient magnetic flux across a gap to achieve a heating temperature rise for a workpiece passing through the gap in a particular application. In FIG. 2, the inductors, 14*a* through 14*f*, are shown diagrammatically and are suitably connected to one or more alternating current power sources (not shown in the figure). In all examples of the invention, suitable mounting structure for the ferromagnetic sections and the induction coils can be provided and is not shown in the drawings. While all of the through-gaps in apparatus 10 are shown along one (upper) side of the apparatus, multiple through-gaps may be distributed over two or more side of the apparatus, for example, along the height, H, or return length RL.

FIG. 3(*a*), FIG. 3(*b*) and FIG. 3(*c*) illustrate apparatus 10*a* of the present invention, which is similar to the apparatus shown in FIG. 2 except that the inductors are formed from multi-turn solenoidal coils 24*a* through 24*f*. Each solenoidal coil is helically wound around each section of ferromagnetic material facing a gap. Although not so illustrated in the drawings, preferably, each coil extends to near the edge of the ferromagnetic material at each gap (for example, edges 12*b*' and 12*c*' in FIG. 3(*b*)) so that each coil is positioned around the ferromagnetic material adjacent to a side of the through-gaps. As illustrated in FIG. 3(*d*), in this example of the invention, each solenoidal coil is suitably connected to power supply bus bars 26*a* and 26*b* (separated by dielectric 26*c*) that supply alternating current to the solenoidal coils (connected in parallel) from single phase power source (PS).

Figures 4A, 4B, 5A:
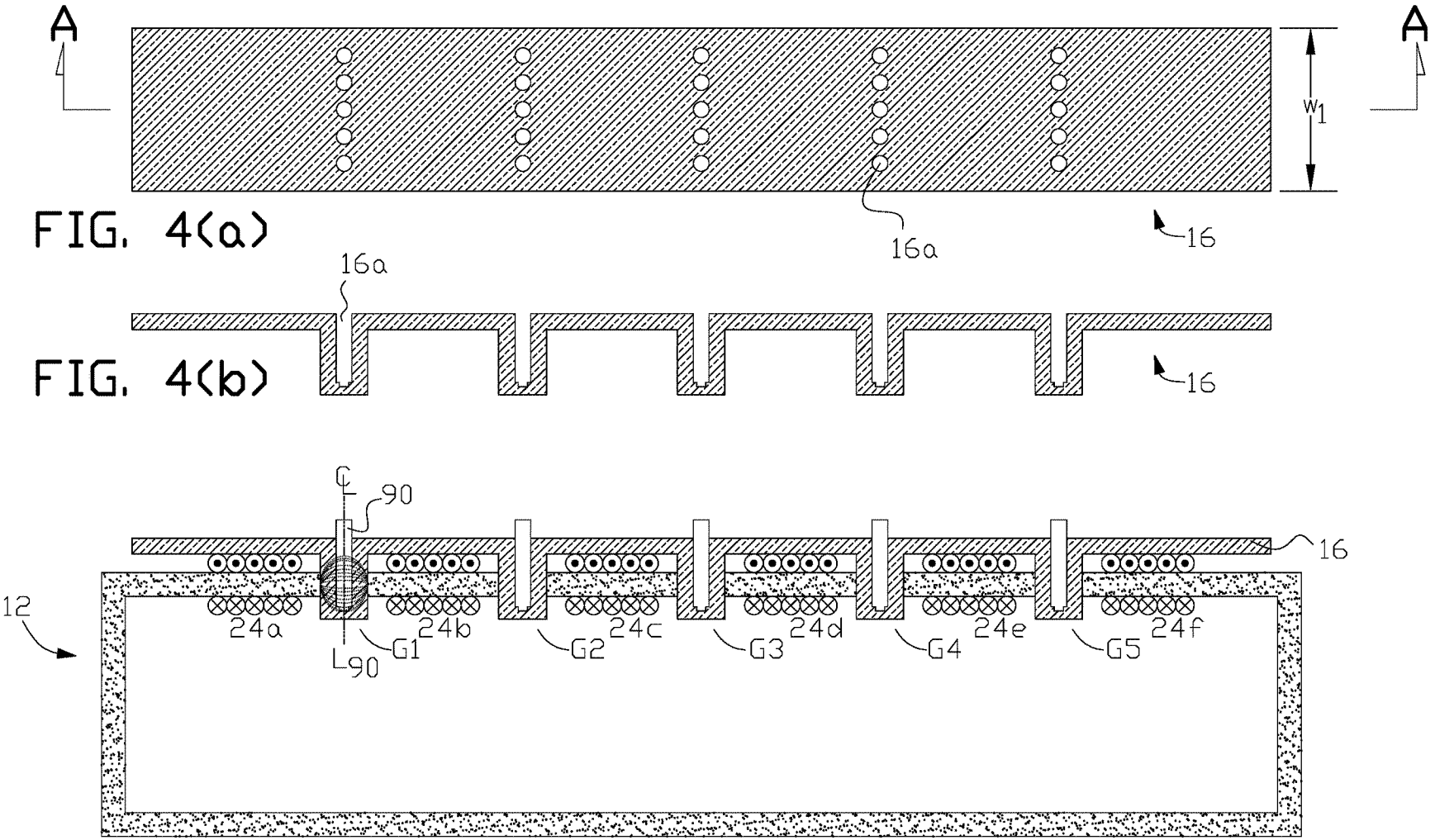
FIG. 4(*a*) and FIG. 4(*b*) illustrate in top and side cross sectional (through line A-A in FIG. 4(*a*)) views, respectively, a workpiece transport apparatus for transporting the workpiece shown in FIG. 1 to and from the apparatus shown in FIG. 3(*a*) through FIG. 3(*d*).
FIG. 5(*a*) is a side cross sectional elevational view of the induction heat treatment apparatus shown in FIG. 3(*b*) with a filled workpiece transport apparatus shown in FIG. 4(*a*) and FIG. 4(*b*) seated in the induction heat treatment apparatus.

One example of a workpiece transport apparatus 16 is illustrated in FIG. 4(*a*) and FIG. 4(*b*). Apparatus 16 can be used to transport workpieces from a workpiece fill station where pre-heat-treated workpieces can be loaded into openings 16*a* and moved to an electric induction heat treatment apparatus of the present invention as illustrated, for example, in FIG. 5(*a*), and then to a post-heat-treated workpiece empty station. In this example apparatus 16 can accommodate 25 workpieces in a 5 row by 5 column (air gap) array. Thus ferromagnetic material 12 extends in width at least to the width, $w_1$, of the transport apparatus. Apparatus 16 can be formed from an electromagnetically transparent material such as a heat resistant ceramic.

Figure 5B:
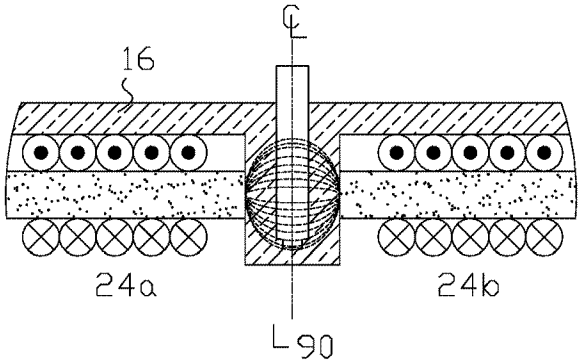

Alternatively apparatus 16 may be formed at least partially from an electromagnetically conductive material having a composition that will not deform when subjected to the induced heating levels necessary to inductively heat treat workpieces 90 situated in the transport apparatus that is seated over apparatus 10*a* as shown in FIG. 5(*a*); with this arrangement heat from the inductive heating of the transport apparatus in the path of the generated magnetic flux can transfer by conduction and radiation to workpieces 90 to supply additional heat to the workpieces in addition to that provided by induced heating of the workpiece itself.

With suitable alternating current supplied to induction coils 24*a* through 24*f* a transversely oriented magnetic flux cuts through the axial (longitudinal axis) length, $L_{90}$, of the workpiece as typically illustrated by the dashed lines for workpiece 90 shown in air gap G1 in FIG. 5(*a*), and in enlarged detail in FIG. 5(*b*).

Figure 6A:
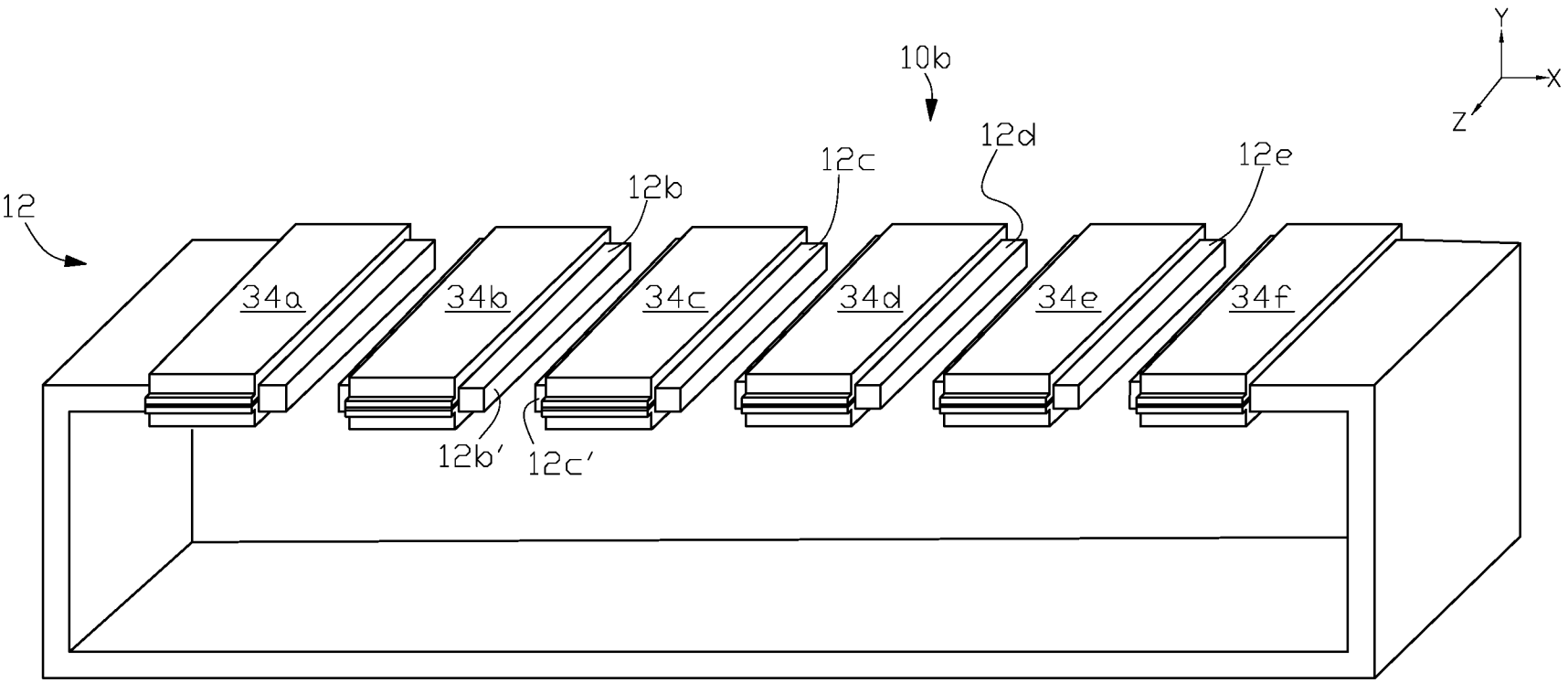
FIG. 6(*a*) is an isometric view of another example of an electric induction heat treatment apparatus of the present invention utilizing single turn sheet inductors.
Figure 6B:
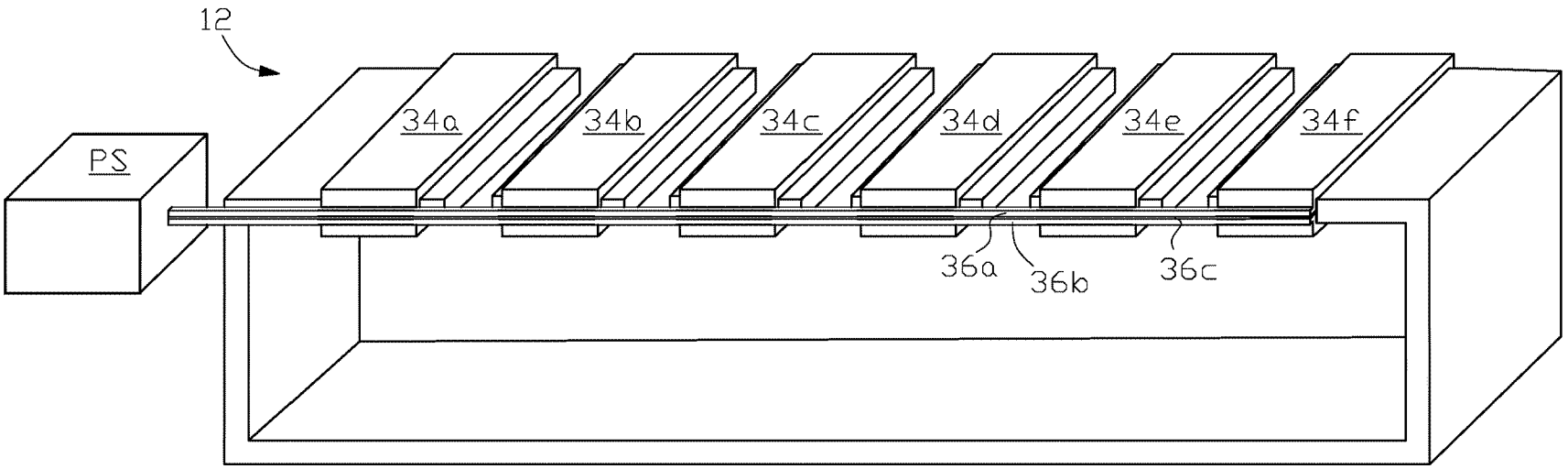

FIG. 6(*a*) and FIG. 6(*b*) illustrate apparatus 10*b* of the present invention, which is similar to the apparatus shown in FIG. 2 except that the inductors are formed from single-turn sheet inductors 34*a* through 34*f*. Each single-turn sheet inductor may be formed, for example, from a copper sheet and may be wound around each section of ferromagnetic material facing a longitudinally-oriented gap. Although not so illustrated in the drawings, preferably each sheet inductor extends to the edge at each gap (for example, edges 12*b*' and 12c' in FIG. 6(a)) so that each sheet inductor is positioned around the ferromagnetic material adjacent to a side of the through-gaps. As illustrated in FIG. 6(b), in this example of the invention, each single-turn sheet inductor is suitably connected to power supply bus bars 36a and 36b (separated by dielectric 36c) that supply alternating current to the solenoidal coils (connected in parallel in this example) from power source (PS).

Figure 7B:
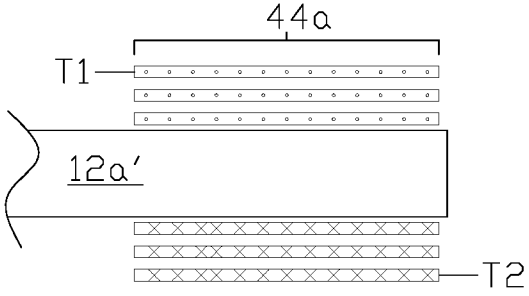
FIG. 7(*a*) is a cross sectional view of another example of an electric induction heat treatment apparatus of the present invention utilizing multi-layer ribbon wound ribbon inductors.
Figure 7A:
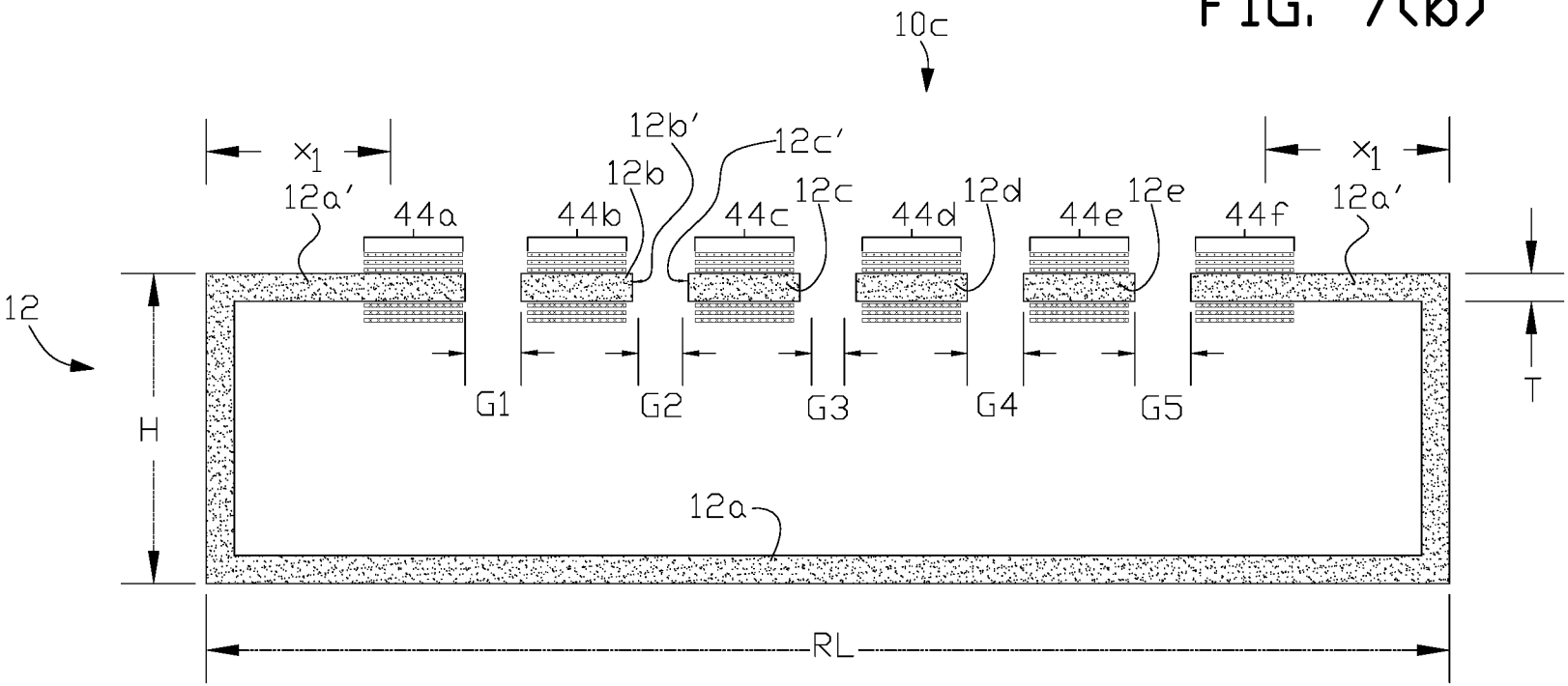
Figure 7D:
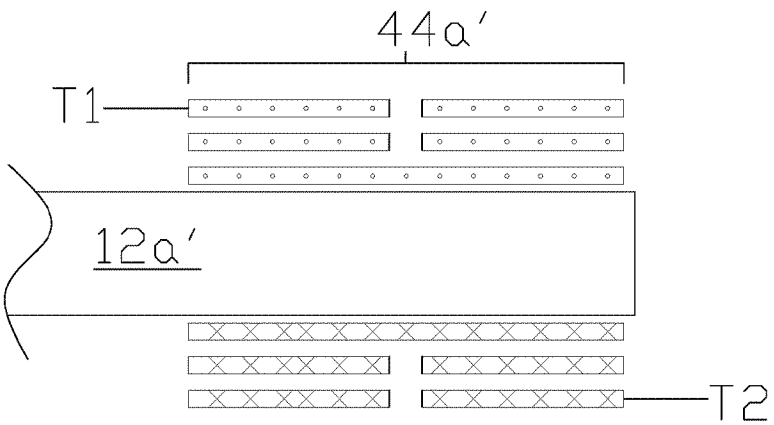
Figure 7C:
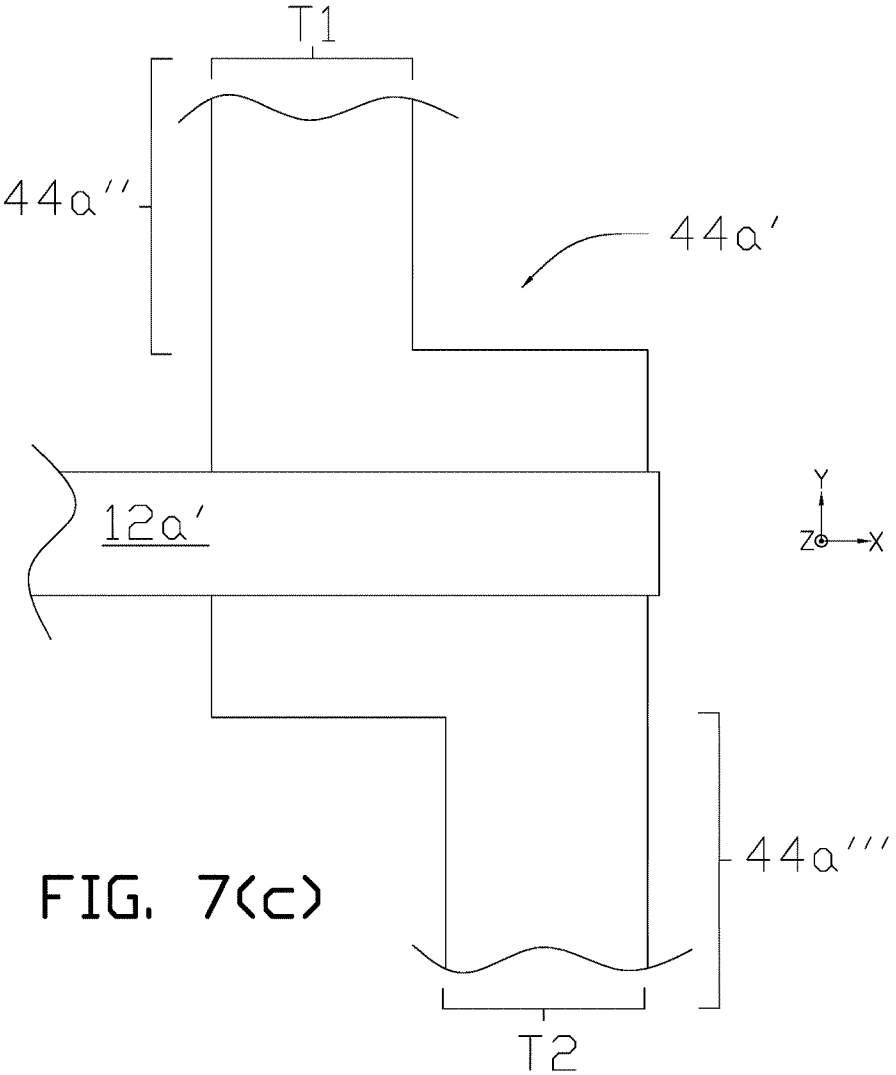

FIG. 7(a) illustrates apparatus 10c of the present invention, which is similar to the apparatus shown in FIG. 2 except that the inductors are formed from multi-layer wound ribbon inductors 44a through 44f wherein the ribbon comprises an electrical conductor/insulator two-layer composite material or separate back to back electrical conductor and insulator layers that can be wound in an overlapping multi-layer arrangement such that substantially all of the magnetic flux is contained to the ferrite. Each multi-layer ribbon inductor is wound around each section of ferromagnetic material facing a gap and suitably connected to an alternating current power source, for examples at terminals T1 and T2 as illustrated in FIG. 7(b) for multi-layer wound ribbon inductor 44a. FIG. 7(c) illustrates on method of wrapping a multi-layer wound ribbon inductor 44a' (shown flat in FIG. 7(c)) around ferromagnetic section 12a' and adjacent to a side of a through-gap where half-section 44a" is wrapped counterclockwise (about X-axis in Y-Z direction) around ferromagnetic section 12a' and half-section 44a'" is wrapped clockwise (about X-axis in Y-Z direction) around ferromagnetic section 12a' to achieve the wound configuration shown in FIG. 7(d). Preferably each wound ribbon inductor extends to the edge at each gap (for example, edges 12b' and 12c' in FIG. 7(a)).

Figure 8A:
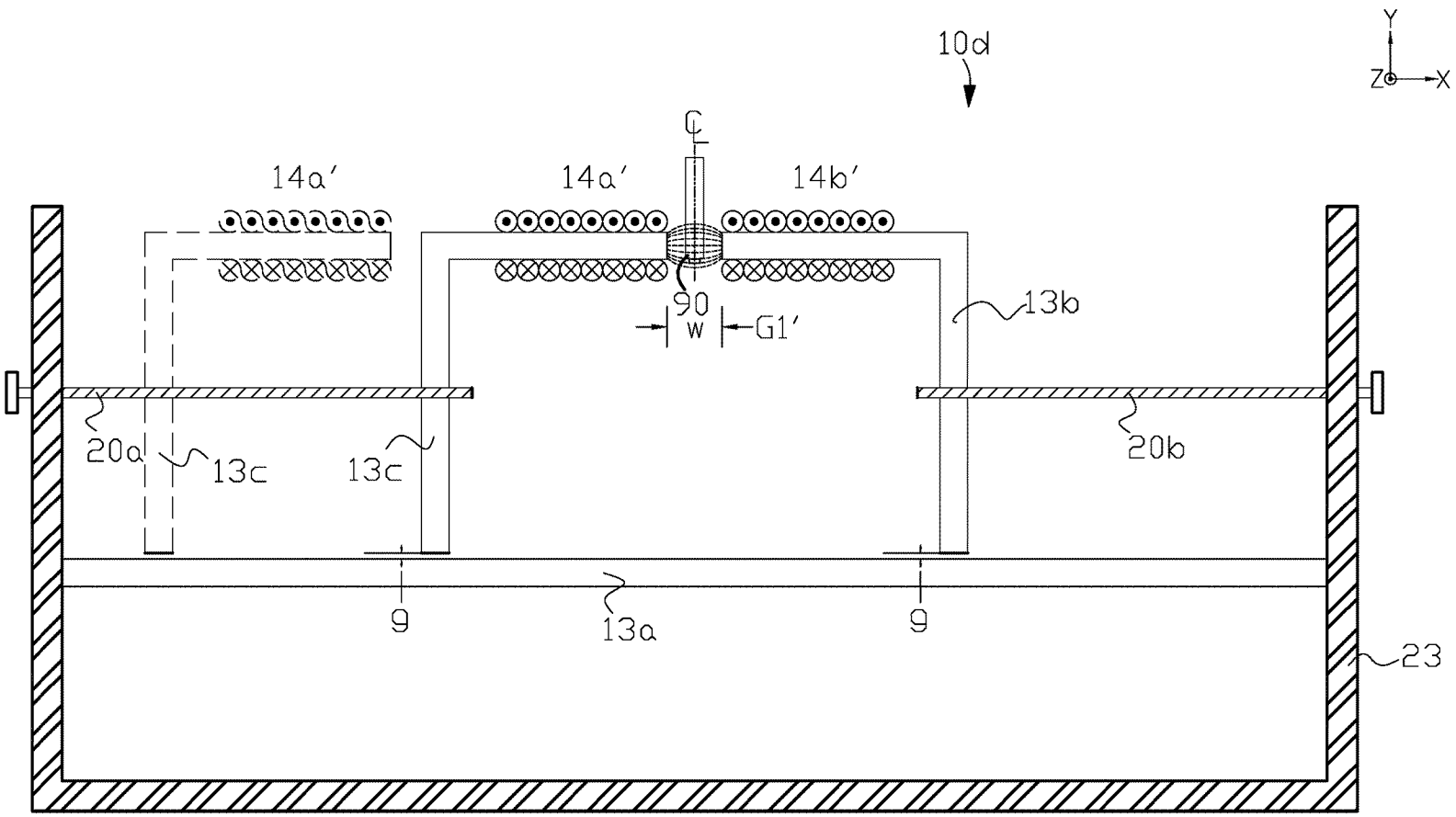
FIG. 8(*a*) is a cross sectional view of another example of an electric induction heat treatment apparatus of the present invention with a single adjustable-width through-gap.

FIG. 8(a) illustrates another example of the present invention where apparatus 10d accommodates induction heat treatment of a single workpiece. The open-box ferromagnetic material comprises ferromagnetic sections 13a, 13b and 13c. Fixed ferromagnetic section 13a may be mounted to suitable structural element 23. Inductors 14a' and 14b' surround the ferromagnetic material on opposing sides of gap G1' and adjacent to each side of the gap. Optionally suitable position actuators 20a and 20b can be provided to control X-direction positioning of either one or both of the opposing "L" shaped ferromagnetic sections 13b and 13c based upon the dimensions of a particular workpiece and the desired transverse flux pattern across the workpiece in the gap so that the apparatus 10d has an adjustable-width longitudinally-oriented workpiece through-gap. For example actuators 20a and 20b may be threaded devices that when rotated (about the X-axis) interact with threaded connections in ferromagnetic sections 13c and 13b respectively to move ferromagnetic sections in the X-direction. A sample alternative position for ferromagnetic section 13c is shown in dashed lines in FIG. 8(a). Suitable apparatus can also be provided to control X-direction positioning of the ferromagnetic segments between one or more of the transverse flux induction heating gaps used in the multi-gap examples of the invention described above. Optionally a suitable (Y-direction) position actuator can be provided to control the width of gap, g, between fixed ferromagnetic section 13a and moveable ferromagnetic sections 13b and 13c to control the reluctance in the magnetic circuit in FIG. 8(a).

Figure 8B:
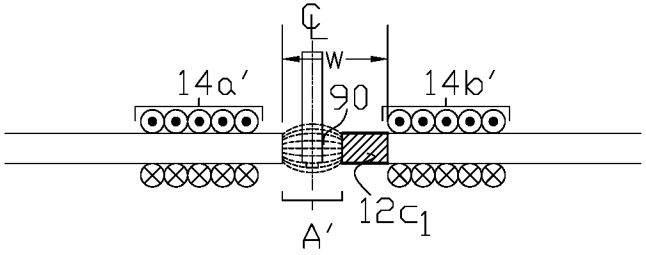
Figure 8C:
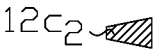
Figure 8D:
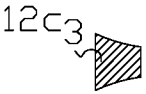
Figure 8E:
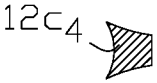

As an alternative to movement of ferromagnetic sections to adjust the width, w, of a gap, or in combination therewith, in some examples of the invention flux path adaptors, or control tips, can be utilized. In some applications the adaptor may be used only to reduce the width of a gap, w. In these applications the adaptor ($12c_1$), as shown in FIG. 8(b) would be shaped identical to the end of the ferromagnetic section it is attached to. In other applications, as shown in FIG. 8(c) through 8(e) the magnetic flux control tip ($12c_2$-$12c_4$) is contoured to alter the transverse flux pattern in the gap. A suitable non-electromagnetic mounting apparatus formed for example, from a ceramic composition, can be provided to allow quick replacement or removal of an adaptor without modification to a heating apparatus of the present invention.

Figure 9A:
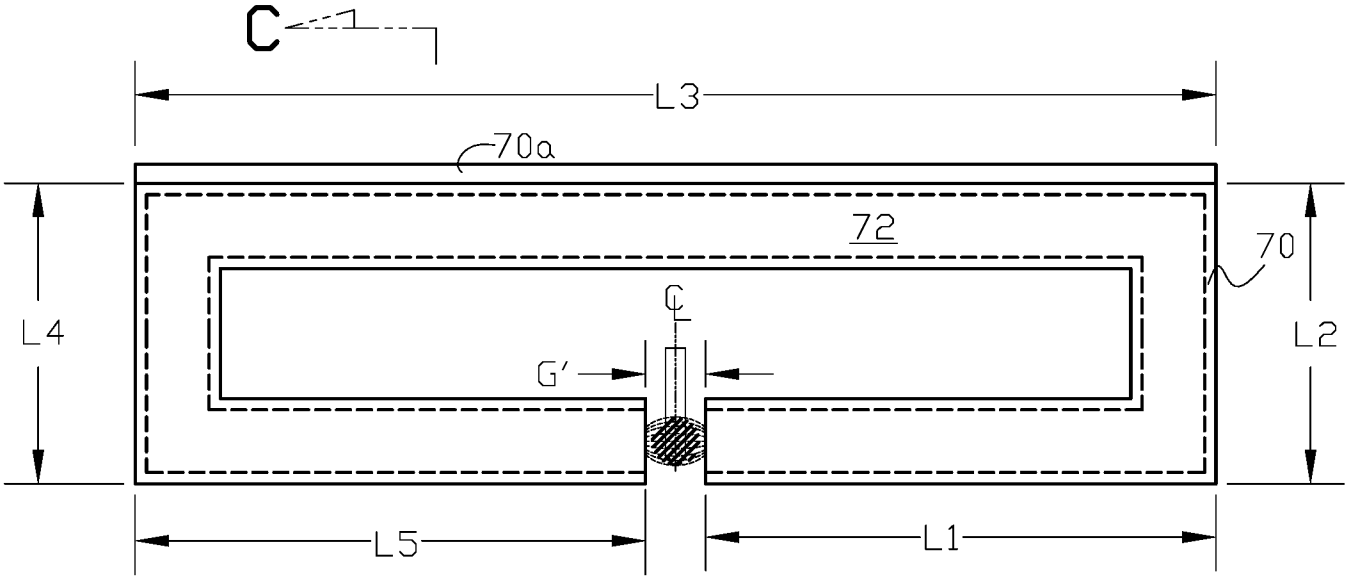
FIG. 9(*a*) is a plan view of another example of an electric induction heat treatment apparatus of the present invention with a single through-gap that utilizes a single-turn sheet inductor enclosing a ferromagnetic material.
Figure 9B:
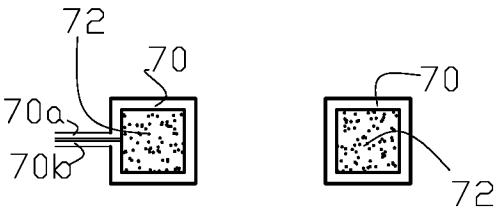
Figure 12B:
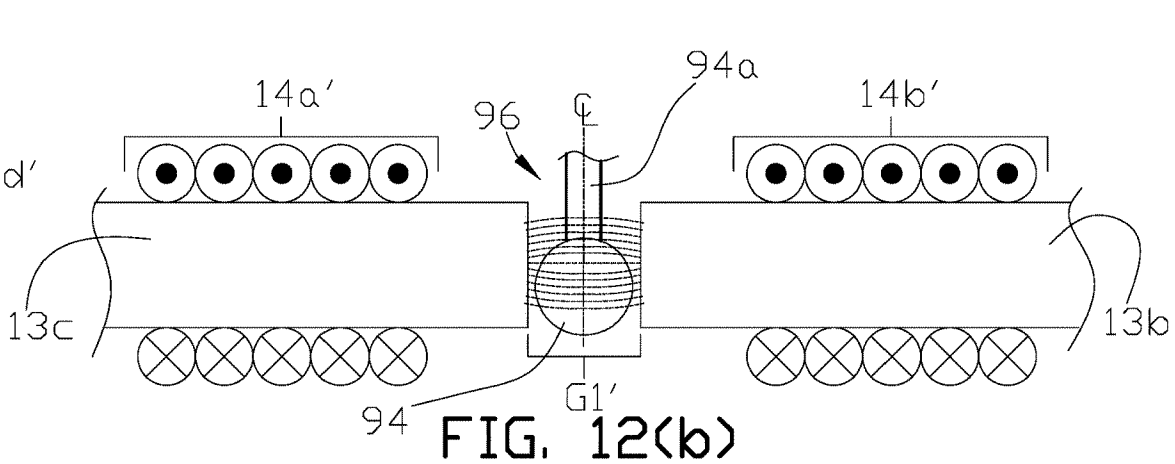
FIG. 12(*a*) is an isometric view of another example of a workpiece that can be heat treated with an apparatus of the present invention where the heat treatment is braze welding of components of the workpiece.

FIG. 9(a) and FIG. 9(b) illustrate another example of the electric induction heat treatment apparatus of the present invention where a single-turn sheet inductor 70 (for example, formed a copper sheet) surrounds the entire length (L1+L2+L3+L4+L5) (except for the facing gap sides (tips)) of a C-shaped ferromagnetic open-box rectangular material 72 having a longitudinally-oriented workpiece through-gap G' in which a longitudinally-oriented workpiece moves through. Alternating current power is suitably supplied to the sheet inductor, for example at side terminals 70a and 70b. In some example of the invention, the entire length of the open-box rectangular ferromagnetic material for apparatus 10d in FIG. 8(a) can be surrounded by a single inductor of any type described above. Similarly the entire length of the open-box rectangular ferromagnetic material for apparatus 10 in FIG. 2 can be surrounded by an inductor of any type; that is, end inductors 14a and 14f can be extended as a single inductor entirely around sides H and return length RL.

Figure 10A:
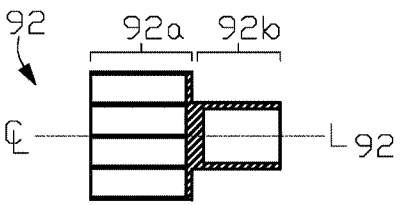
FIG. 10(*a*) is a cross sectional elevational view of another example of a workpiece with a section having a centerline longitudinal axis that can be induction heat treated with the apparatus and method of the present invention.
Figure 10B:
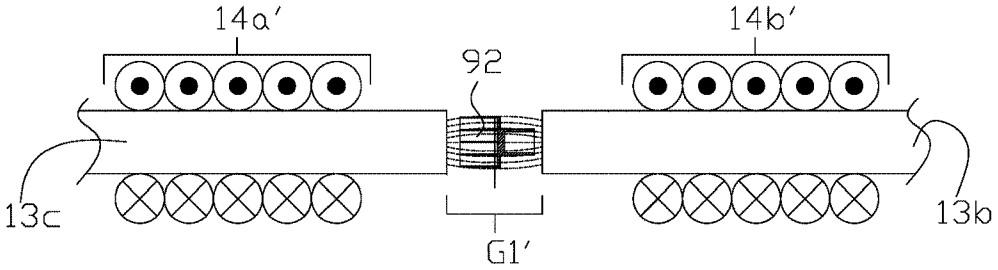
Figure 10C:
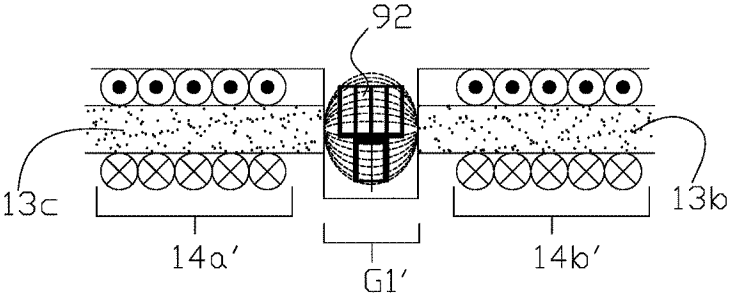

FIG. 10(a) illustrates another example of a workpiece that can be advantageously induction heat treated in an apparatus of the present invention. Workpiece 92 comprises multiple interconnected open cylindrical sections oriented along longitudinal axis $L_{92}$ that require metallurgical heat treatment. Workpiece 92 can be an article such as a wrench socket where section 92a is of an open cylindrical shape forming the volume in which a fastener or other object is inserted for torque application (for example a hex nut or spark plug), and section 92b is of an open cylindrical shape forming the volume by which a hand or powered wrench is attached to the socket. Workpiece 92 is axially inserted in the gap G1' of the apparatus partially shown in FIG. 10(b). A suitable batch workpiece transport apparatus can be utilized to hold workpiece 92 in place in the gap, or a conveyor apparatus can be provided to convey workpieces through the length, L, of a gap. The representative flux (dashed) lines illustrate transverse flux penetration along the longitudinal axis of workpiece 92. In the example in FIG. 10(b) the central longitudinal axis $L_{92}$ of the workpiece 92 is aligned parallel to transverse flux field; in other examples of the present invention the longitudinal axis $L_{92}$ of the workpiece 92 is aligned perpendicular to the transverse flux field as shown in FIG. 10(c).

Figure 11B:
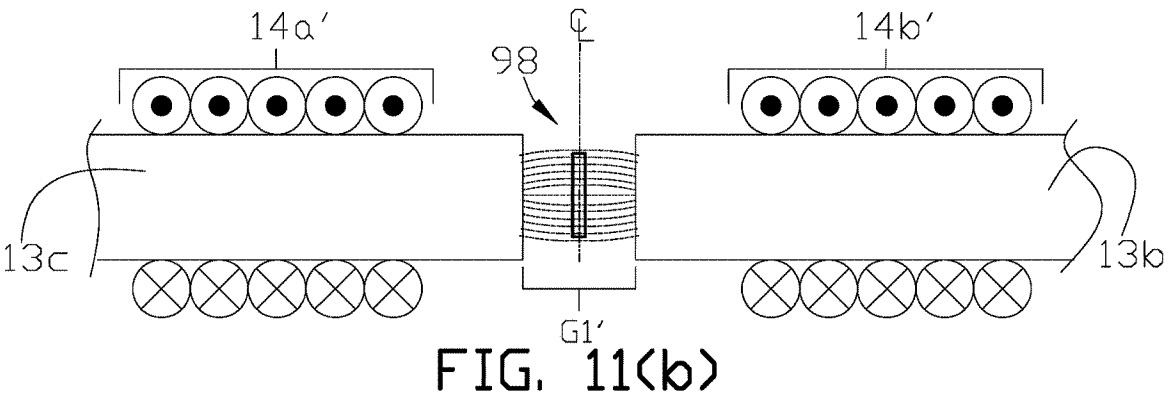
FIG. 11(*a*) is a plane and elevational view of an example of a planarly-oriented workpiece that can be induction heat treated with the apparatus and method of the present invention.
Figure 11A:
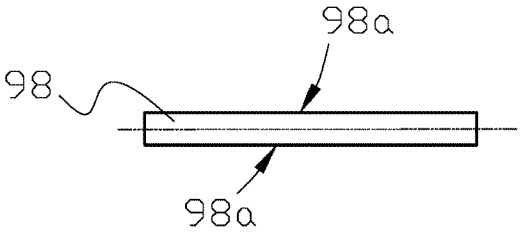
Figure 11A:
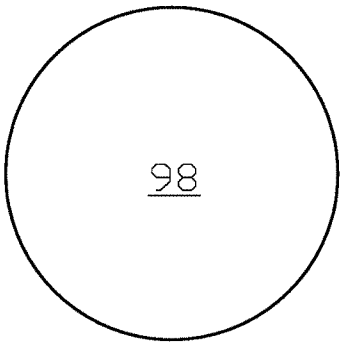

FIG. 11(a) illustrates another example of a discrete workpiece that can be advantageously induction heat treated in an apparatus of the present invention. In FIG. 11(a) planar workpiece 98 comprises a thin circular blank preform that has opposing planar surfaces 98a. The preform is a blank that after heating can be stamped into a coin. Blank planar workpiece 98 is oriented with its planar surfaces perpendicular to the transverse magnetic flux field established in the gap as shown in FIG. 11(b). As in the previous examples of the invention a suitable transport apparatus for moving a coin through the gap can be provided.

Figure 12A:
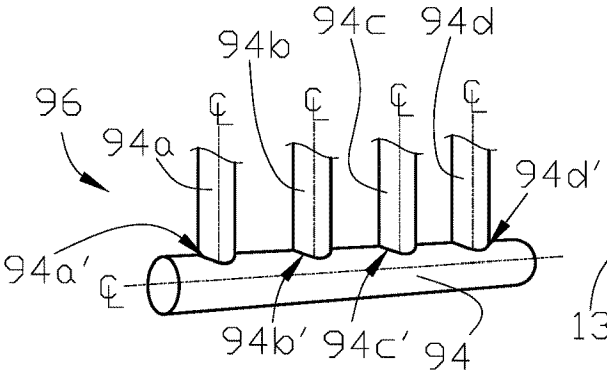

In the present invention, the term "heat treatment" includes braze welding of workpiece components within the through-gap of an apparatus of the present invention. For example in FIG. 12(a) manifold 96 has four tubes 94a through 94*d* that can be brazed welded to main tube 94 at joints 94*a*' through 94*d*'. The joint between each tube and main tube 94 can be braze welded as the tubes comprising the manifold move through the gap of an apparatus of the present invention.

As an alternative to the workpiece transport apparatus utilized in the above examples of the invention for batch heat treatment of workpieces, a suitable conveyor apparatus or linear way can be used in other examples of the invention to transport a series of workpieces through the length, L, of a gap. In some applications the induction heating of the workpiece in the gap requires a sealed environment, in which cases a sealed tunnel may be provided in the longitudinal gap of the apparatus.

The term "heat treatment" is used herein to describe an industrial process wherein induction heat application to the workpiece can be utilized either as an alternative to an existing induction heat treatment process or replacement of a non-induction heat treatment process. Further the workpiece may be a composite wherein only a partial constituent of the workpiece composition is electrically conductive for induced eddy current heating.

The present invention has been described in terms of preferred examples and embodiments. Equivalents, alternatives and modifications, aside from those expressly stated, are possible and within the scope of the invention.

The invention claimed is:

1. An electric induction heat treatment apparatus for a heat treatment of at least one discrete workpiece having a longitudinal axis, the electric induction heat treatment apparatus comprising:

a series magnetic loop circuit formed from:

an open-box rectangular ferromagnetic material; and at least one workpiece single pass longitudinally-oriented through-gap formed in the open-box rectangular ferromagnetic material through which the at least one discrete workpiece passes through;

two or more inductors, each of the two or more inductors comprising a solenoidal coil, each of the two or more inductors positioned around the open-box rectangular ferromagnetic material adjacent to a side of each one of the at least one workpiece single pass longitudinally-oriented through-gap;

at least one alternating current power supply connected to each of the two or more inductors to establish a transverse magnetic flux in each one of the at least one workpiece single pass longitudinally-oriented through-gap; and a discrete workpiece transport system for positioning the longitudinal axis of each of the at least one discrete workpieces perpendicular or parallel to the transverse magnetic flux as each of the at least one discrete workpieces passes through the at least one workpiece single pass longitudinally-oriented through-gap.

2. The electric induction heat treatment apparatus of claim 1 wherein the at least one workpiece single pass longitudinally-oriented through-gap comprises a single adjustable-width workpiece single pass longitudinally-oriented through-gap.

3. The electric induction heat treatment apparatus of claim 2 further comprising a flux path adaptor inserted in the single adjustable-width workpiece single pass longitudinally-oriented through-gap.

4. The electric induction heat treatment apparatus of claim 2 further comprising at least one section of the open-box rectangular ferromagnetic material moveably configured for adjustment of a width of the single adjustable-width workpiece single pass longitudinally-oriented through-gap.

5. The electric induction heat treatment apparatus of claim 1 wherein the two or more inductors surround an entire length of the open-box rectangular ferromagnetic material.

6. The electric induction heat treatment apparatus of claim 1 wherein the discrete workpiece transport system is at least partially electromagnetically conductive.

7. The electric induction heat treatment apparatus of claim 1 wherein the at least one discrete workpiece comprises a plurality of closed bottom cylindrically shaped hollow metal preforms, a closed bottom of each one of the plurality of closed bottom cylindrically shaped hollow metal preforms having a greater thickness than a side wall of each one of the plurality of closed bottom cylindrically shaped hollow metal preforms and the discrete workpiece transport system comprises a heat resistant ceramic having a series of individual openings for each one of the plurality of closed bottom cylindrically shaped hollow metal preforms for all of the plurality of closed bottom cylindrically shaped hollow metal preforms passing through all of the at least one workpiece single pass longitudinally-oriented through-gaps.

8. A method of inductively heat treating at least one discrete workpiece having a longitudinal central axis, the method comprising the steps of:

supplying an alternating current power to a series magnetic loop circuit formed from an open-box rectangular ferromagnetic material having at least one workpiece single pass longitudinally-oriented through-gap, the alternating current power supplied to at least two solenoidal coils positioned around the open-box rectangular ferromagnetic material adjacent to a side of each one of the at least one workpiece single pass longitudinally-oriented through-gap;

establishing a transverse magnetic flux across a width of each one of the at least one workpiece single pass longitudinally-oriented through-gap from the alternating current power; and moving each one of the at least one discrete workpieces with the longitudinal central axis perpendicular or parallel to the transverse magnetic flux through one of the at least one workpiece single pass longitudinally-oriented through-gap in a discrete workpiece transport system.

9. The method of claim 8 further comprising the step of adjusting the width of the at least one workpiece single pass longitudinally-oriented through-gap.

10. The method of claim 8 further comprising the step of at least partially electromagnetically heating the discrete workpiece transport system.

11. The method of claim 8 wherein the at least one discrete workpiece comprises a closed bottom cylindrically shaped hollow metal preform, the closed bottom cylindrically shaped hollow metal preform having a greater thickness than a side wall of the closed bottom cylindrically shaped hollow metal preform and the discrete workpiece transport system comprises a heat resistant ceramic having a series of individual openings for each one of a plurality of the closed bottom cylindrically shaped hollow metal preforms.

12. An electric induction heat treatment apparatus for a heat treatment of at least one discrete planarly-oriented workpiece having a planar surface, the electric induction heat treatment apparatus comprising:

a series magnetic loop circuit formed from:

an open-box rectangular ferromagnetic material; and at least one workpiece single pass longitudinally-oriented through-gap formed in the open-box rectangular ferromagnetic material through which the at least one discrete planarly-oriented workpiece passes through;

two or more inductors, each of the two or more inductors comprising a solenoidal coil, each of the two or more inductors positioned around the open-box rectangular ferromagnetic material adjacent to a side of each one of the at least one workpiece single pass longitudinally-oriented through-gap;

at least one alternating current power supply connected to each of the two or more inductors to establish a transverse magnetic flux in each one of the at least one workpiece single pass longitudinally-oriented through-gap; and a discrete workpiece transport system for positioning the planar surface of each of the at least one discrete planarly-oriented workpieces perpendicular to the transverse magnetic flux as each of the at least one discrete planarly-oriented workpieces passes through one of the at least one workpiece single pass longitudinally-oriented through-gap.

13. The electric induction heat treatment apparatus of claim 12 wherein the at least one workpiece single pass longitudinally-oriented through-gap comprises a single adjustable-width workpiece single pass longitudinally-oriented through-gap.

14. The electric induction heat treatment apparatus of claim 12 wherein the discrete workpiece transport system is at least partially electromagnetically conductive.

15. A method of inductively heat treating at least one discrete planarly-oriented workpiece having a planar surface, the method comprising the steps of:

supplying an alternating current power to a series magnetic loop circuit formed from an open-box rectangular ferromagnetic material having at least one workpiece single pass longitudinally-oriented through-gap, the alternating current power supplied to at least two solenoidal coils positioned around the open-box rectangular ferromagnetic material adjacent to a side of each one of the at least one workpiece single pass longitudinally-oriented through-gap;

establishing a transverse magnetic flux across a width of each one of the at least one workpiece single pass longitudinally-oriented through-gap from the alternating current power; and moving each one of the at least one discrete planarly-oriented workpieces with the planar surface perpendicular to the transverse magnetic flux through each one of the at least one workpiece single pass longitudinally-oriented through-gap in a discrete workpiece transport system.

16. The method of claim 15 further comprising the step of adjusting the width of the at least one workpiece single pass longitudinally-oriented through-gap.

17. An electric induction heat treatment apparatus for a heat treatment of at least one discrete workpiece having at least two components with a longitudinal axis, the electric induction heat treatment apparatus comprising:

a series magnetic loop circuit formed from:

an open-box rectangular ferromagnetic material; and at least one workpiece single pass longitudinally-oriented through-gap formed in the open-box rectangular ferromagnetic material through which the at least one discrete workpiece passes through;

two or more inductors, each of the two or more inductors comprising a solenoidal coil, each of the two or more inductors positioned around the open-box rectangular ferromagnetic material adjacent to a side of each one of the at least one workpiece single pass longitudinally-oriented through-gap;

at least one alternating current power supply connected to each of the two or more inductors to establish a transverse magnetic flux in each one of the at least one workpiece single pass longitudinally-oriented through-gap; and a discrete workpiece transport system for positioning the longitudinal axis of the at least two components of the at least one discrete workpiece perpendicular to the transverse magnetic flux as each of the at least one discrete workpieces passes through the at least one workpiece single pass longitudinally-oriented through-gap to braze weld the at least two components together.

18. A method of inductively heat treating at least one discrete workpiece having at least two components with a longitudinal axis, the method comprising the steps of:

supplying an alternating current power to a series magnetic loop circuit formed from an open-box rectangular ferromagnetic material having at least one workpiece single pass longitudinally-oriented through-gap, the alternating current power supplied to at least two solenoidal coils positioned around the open-box rectangular ferromagnetic material adjacent to a side of each one of the at least one workpiece single pass longitudinally-oriented through-gap;

establishing a transverse magnetic flux across a width of each one of the at least one workpiece single pass longitudinally-oriented through-gap from the alternating current power; and moving each one of the at least one discrete workpieces with the longitudinal axis of the at least two components of the at least one discrete workpiece perpendicular to the transverse magnetic flux through each one of the at least one workpiece single pass longitudinally-oriented through-gap to braze weld the at least two components together.

19. The method of claim 18 further comprising the step of adjusting the width of the at least one workpiece single pass longitudinally-oriented through-gap.

20. The method of claim 18 wherein the at least one discrete workpiece having at least two components with a longitudinal axis comprises a manifold where the at least two components comprise a plurality of manifold tubes joined to a manifold main tube.

* * * * *